US005952962A

United States Patent [19]

Dybdal

[11] Patent Number: 5,952,962

[45] Date of Patent: Sep. 14, 1999

[54] EXTENDED SPATIAL ACQUISITION METHOD FOR TRACKING ANTENNAS

[75] Inventor: Robert B. Dybdal, Palos Verdes Estates, Calif.

[73] Assignee: The Aerospace Corporation, El Segundo, Calif.

[21] Appl. No.: 08/942,072

[22] Filed: Oct. 1, 1997

[51] Int. Cl.[6] ..... H01Q 3/00

[52] U.S. Cl. ..... 342/359; 342/75

[58] Field of Search ..... 342/75, 359

[56] References Cited

U.S. PATENT DOCUMENTS 3,406,393 10/1968 Kulik ..... 342/75

5,245,348 9/1993 Nishikawa et al. ..... 342/359

5,274,382 12/1993 Wills et al. ..... 342/359

*Primary Examiner*—Mark Hellner

*Attorney, Agent, or Firm*—Derrick Michael Reid

[57] ABSTRACT

An extended spatial acquisition method extends the spatial acquisition range for tracking antennas. The method employs a multiple feed cluster to sense the received signal with high sensitivity and to spatially acquire the received signal when uncertainty in the received signal arrival direction exceeds several beamwidths. A main beam consisting of a collection of beams including a central beam and surrounding beams of the cluster extend the spatial acquisition range to include the surrounding beams. Feed signal strengths are measured to determine where within the extended field of view a desired signal arrives and then the antenna is repositioned to point the central beam toward the desired signals after which central beam tracking occurs.

14 Claims, 2 Drawing Sheets

FIG. 2
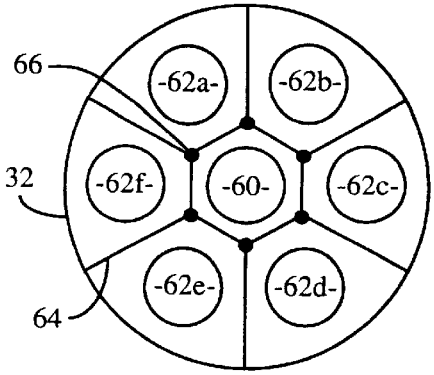
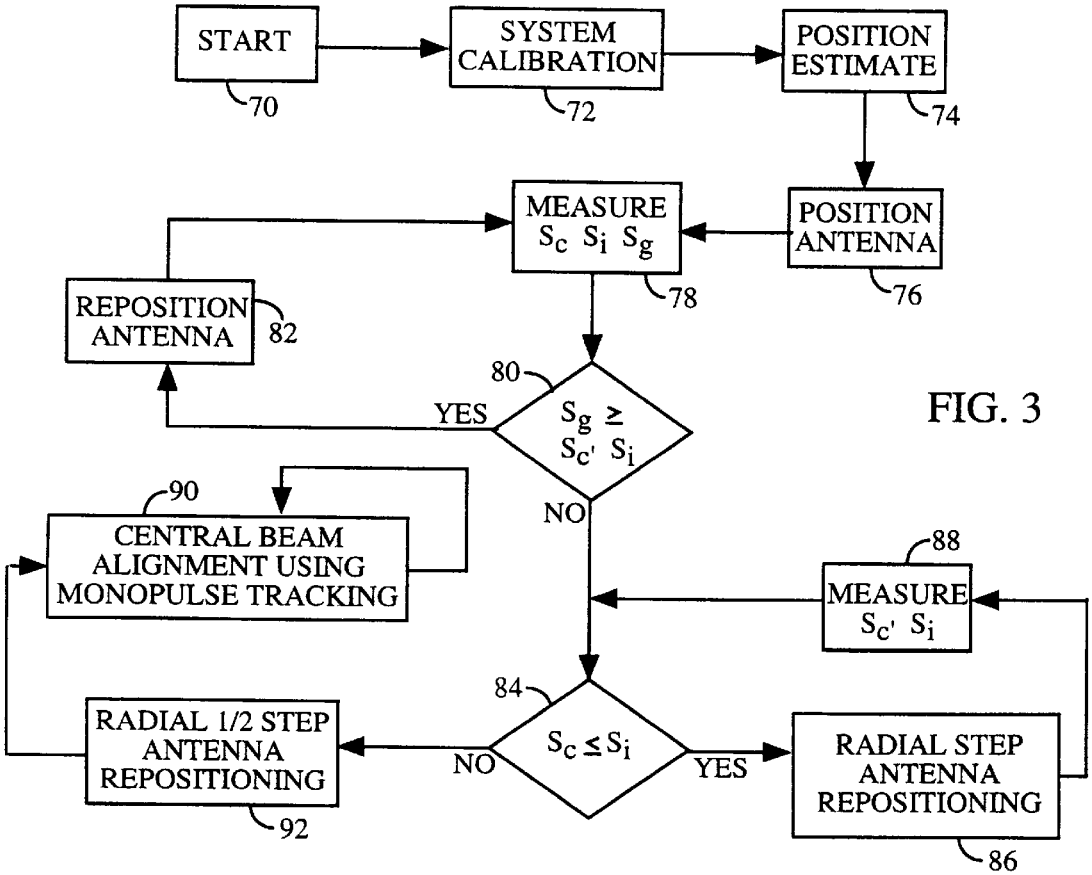
FIG. 3

EXTENDED SPATIAL ACQUISITION METHOD FOR TRACKING ANTENNAS

STATEMENT OF GOVERNMENT INTEREST

The invention was made with Government support under Contract No. F04701-88-C-0089 by the Department of the Air Force. The Government has certain rights in the invention.

The invention described herein may be manufactured and used by and for the government of the United States for governmental purpose without payment of royalty therefor.

SPECIFICATION

Field of the Invention

The present invention broadly relates to antenna systems used in communication applications and the spatial alignment of the antenna systems to received signals.

Background of the Invention

Achieving the maximum sensitivity in communication systems requires aligning the antenna in the direction of the desired signal. In this way, the desired signal direction is aligned with the beam pattern maximum antenna gain level producing the maximum sensitivity. Generally, the location of the source of the desired signal is known to some precision a priori. If the antenna beamwidth is relatively broad, the knowledge of the desired signal source location may be adequate to point the antenna in alignment with the desired signal with relatively little loss in sensitivity. However, with narrow beamwidth antennas, the knowledge of the desired signal direction may not be sufficiently precise to align the antenna with the desired signal direction without incurring a degradation in reception sensitivity. In such cases, other means of accurately positioning the antenna to avoid sensitivity reduction must be devised.

High gain tracking antennas are spatially limited in acquiring a desired signal because of inherent narrow beamwidths. Methods to expand the field of view for spatial acquisition are typically needed at EHF frequencies because high gain levels can be achieved from relatively compact antenna designs, because wide EHF bandwidths require high antenna gain for link closure, and because EHF weather sensitivity increases the required gain to offset rain attenuation. Such EHF systems have significant sensitivity to losses resulting from rain, particularly at low elevation angles where the path length through rain is long. In applications where low elevation angle operation is required, e.g., a ground terminal antenna required to acquire a low altitude satellite when it clears the horizon, sensitivity is a critical system parameter. It is desirable to acquire and track the satellite as soon and reliably as possible to maximize the information that can be transferred while the satellite is in view.

Conventional tracking antennas are able to accurately align an antenna beam with the received desired signal when the uncertainty in the desired signal arrival direction is approximately equal to the antenna beamwidth. The process of aligning the antenna is normally referred to as pointing. In other cases, the direction of the signal arrival may vary during the reception period, and the antenna alignment must change to follow the signal direction. The process of following the signal direction changes is referred to as tracking. Techniques for pointing and tracking are well known. Conventional antenna systems have included a main reflector, a subreflector, and a feed system all functioning together to establish a single main beam used for both acquisition and tracking.

When narrow antenna beamwidths are used, monopulse methods are commonly applied to perform both the initial pointing and subsequent tracking. These monopulse methods generate two types of antenna beam patterns. The first type of beam pattern is referred to as a sum beam having a maxima on the axis of the antenna, which provides reception of the desired signal. The second type of beam pattern is referred to as a difference beam which has a beam pattern with a null aligned with the axis of the antenna. With excursions away from the axis, the difference beam provides a linear variation with the excursion from the null and is positive on one side of the axis and negative on the other side of the axis. By measuring the ratio of the difference beam signal level over the sum beam signal level, the displacement of the desired signal direction from the antenna axis can be determined. By knowing the sign of this ratio, the appropriate side of the axis can be determined. This information is processed to provide commands to the antenna positioner to properly align the antenna with the desired signal direction. Generally, this information is used by a closed loop system to provide both the initial pointing alignment and the subsequent tracking. These closed loop pointing and tracking methods for antennas have been commonly applied to both communication and radar systems. However, the acquisition field of view of an antenna using the monopulse method is typically limited to the antenna beamwidth where the monopulse slope characteristics are linear.

One disadvantage of the monopulse method is the inability to achieve proper monopulse operation which is limited to the angular extent of the antenna beamwidth corresponding to the linear region of the difference pattern. As long as the uncertainty in the angular direction of the signal is less than the angular size of the antenna beamwidth, the monopulse method is well suited for tracking and pointing. However, the monopulse method can not perform accurate pointing and tracking when the uncertainty in arrival direction exceeds the antenna beamwidth.

Normally, spatial acquisition methods for tracking antennas use a nominal a priori pointing direction that is refined by antenna tracking to minimize pointing loss of one tenth the beamwidth misalignment for less than one tenth dB pointing loss. Ideally, the inaccuracy of the nominal pointing direction is less than the antenna beamwidth, so that standard tracking methods, such as the monopulse method, can realign the antenna with the desired signal to achieve a very small pointing loss. When the nominal pointing direction inaccuracy exceeds the antenna beamwidth, raster, box or spiral scanning pointing methods are commonly used to position the antenna to receive the desired signal within the beamwidth so that the standard monopulse tracking methods can then be used. With narrow antenna beamwidths, the accuracy for the nominal alignment becomes stringent, and the time needed to spatially search for proper alignment can be excessive. Methods to increase the angular region for improved spatial acquisition are desirable to extend the angular range over which spatial acquisition can be achieved.

Two methods have been used to extend the angular range for signal acquisition. The first method commands the antenna to search an angular volume corresponding to the uncertainty in signal direction. A variety of antenna motions have been used, such as spiral, box, raster path scanning pointing movements, where the paths are separated in angle by an amount corresponding to the antenna beamwidth. The disadvantage of this method is the large amount of time required for signal acquisition. In some applications, e.g., acquiring and tracking the signal from a low altitude satellite, an adequate amount of time for signal acquisition may not exist with narrow beamwidth antennas.

The second method uses a second smaller acquisition antenna with a proportionally wider beamwidth for signal acquisition purposes. The desired signal is acquired by the smaller antenna, and tracked by a monopulse system in the smaller antenna. The overall accuracy achieved by the monopulse tracking of the smaller antenna must be equivalent to the beamwidth of the larger antenna. After the desired signal is acquired and positioned by the small antenna so that the large antenna is aligned within its beamwidth, monopulse tracking by the larger antenna is used to refine the antenna positioning so that minimal signal loss occurs. The boresight axes of both the large and small antennas are required to be coincident so that when the desired signal is acquired and tracked by the small antenna, the boresight of the large antenna is pointed in the signal direction determined by the small antenna. The disadvantage of this second method is that the signal acquisition is performed by the smaller antenna having substantially less sensitivity than the larger antenna, because the field of view of the smaller antenna may be about ten times wider than the larger main antenna beam. These and other disadvantages are solved or reduced using the present invention.

SUMMARY OF THE INVENTION

An object of the present invention is to provide a method for increasing antenna sensitivity over an extended angular region for which spatial acquisition can occur.

Another object of the present invention is to provide a method for expanding the field of view of an antenna for spatial acquisition.

The present invention is a method for improved antenna tracking where signal acquisition can be achieved over an angular region extending several antenna beamwidths with a signal sensitivity comparable to the sensitivity of an antenna main beam. The method increases the angular range for spatial acquisition by using multiple feed horns including a central horn surrounded by additional surrounding feed horns. This cluster of beams generated by this feed arrangement function as a main beam collection having an extended field of view. Each surrounding feed horn has a respective beam displaced from the central beam position in proportion to its separation from the central horn. The central horn provides the conventional tracking output of sum and difference signals for conventional monopulse tracking. The surrounding feeds provide respective sum patterns surrounding the central beam and function to sense and acquire the desired signal in an extended field of view increased from beyond the spatial range of the single central feed horn. Preferably, the central horn is surrounded by six additional surrounding feed horns arranged in an equilateral lattice to maximize the minimum gain over the extended field of view. Additional feed horns could be used to further extend the spatial range of the antenna main beam, but each added feed requires respective electronics and acquisition circuitry. The surrounding feeds from the feed cluster can be used to determine when the desired signal arrives within the surrounding beams.

All of the surrounding beams from the surrounding horns have gain levels comparable to the central beam providing high sensitivity for acquisition across the entire extended spatial range. The ability to achieve this comparable level of gain for the central and surrounding beams is a property of Cassegrain reflector designs. This collection of the central feed and the surrounding feeds form the collection of independent beams having high sensitivity over an angular field of view wider than just the central beam. Independent tracking receivers connected to each feed provide the ability to sense the signal arrival in a given beam position. The knowledge of the beam position with the highest received signal level enables the antenna to be repositioned to align the central beam with the desired signal.

A transmit beam uses a separate transmit feed horn imaged by a frequency selective surface which reflects the transmit signal towards the subreflector for reflection to illuminate the main reflector surface. In this way, the feed performance can be individually optimized for transmit and receive operation because transmit and receive frequencies are typically widely spaced. The receive boresight is coincident with the boresight of the transmit beam. The boresight coincidence of the receive and transmit frequency is tightly controlled to avoid pointing losses at the transmit frequencies. A calibration probe may be centered in the subsurface reflector to provide a means to compensate for electronic variations during use, such as electronic drift in the tracking receivers. Only the amplitude response of the surrounding feed receivers needs to be calibrated, because the surrounding feeds measure only received signal power. Additional complexity of phase calibration is not required.

A guard antenna mounted behind the main subreflector provides a guard beam which discriminates against sidelobe reception preventing false tracking of the desired signal. The diameter of the guard antenna is preferably about one tenth of the main reflector antenna. The guard antenna gain and coverage is comparable with the main antenna sidelobes near the main beam. A guard feed and a guard tracking receiver are used to determine when the desired signal arrives outside the surrounding beams. By monitoring the output levels of the guard feed, surrounding feeds and central feed, the desired signal arrival angular position about the main beam collection from the cluster of feeds can be determined, and the antenna can then be repositioned for alignment towards the desired signal to position the central beam towards the desired signal. The use of the surrounding feeds effectively extends the spatial range of the composite beam of the antenna over the single beamwidth of the central beam.

The method of extended spatial acquisition is for improved pointing and tracking by the antenna of a desired signal. Initially, the nominal point direction and time, such as derived from the ephemeris for the satellite and antenna location, is used to position the antenna. The method covers three steps including central beam tracking when the desired signal arrive within the central feed beam, cluster feed pointing when the desired signal arrives within the surrounding feed beams, and the guard beam pointing when the desired signal arrives outside the cluster feed beams. All of the beams and their independent receivers respectively provide feed signals to measure the presence of the desired signal, and by measuring the desired signal levels in the respective beam, the method determines the angular arrival position of the incoming desired signal. The antenna can then be repositioned towards the desired signal.

During central beam tracking, the desired signal is received within the central beam beamwidth. The monopulse method of tracking of the desired signal within central beam using the central feed provides necessary tracking to achieve minimal pointing loss using monopulse signals of the central feed. The central feed has the highest output level when the desired signal arrives within the central beam. The measured power output levels of the additional surrounding feeds, in this case, will be significantly lower than the central feed, thus providing feed signals that can be used to verify that the nominal pointing direction of the antenna aligns the desired signal direction antenna within the central beamwidth.

During cluster feed pointing, the desired signal arrives within the surrounding beams but not within the central beam. The outputs of surrounding feeds are monitored. The output level of the central feed is less than the power level in one or more of the surrounding feeds when the desired signal arrives within the surrounding beams and not within the central beam. Dependent on the signal direction within the feed cluster, the output from the surrounding feeds can be predominantly in a single feed, comparable in two adjacent surrounding feeds when the signal arrives between two adjacent surrounding feeds, or comparable in three surrounding feeds when the signal direction arrives at a triple point between three adjacent surrounding feeds. In all such cases, the surrounding feed outputs are compared with the output from the guard antenna feed to verify that the desired signal arrives within the surrounding beams. When the signal distribution across the feed cluster is known, the direction to reposition the antenna to align the desired signal arrival within central beam is also known. By moving the antenna and monitoring the power variation of the feed outputs of the feed cluster, the antenna can be positioned within the beamwidth of the central feed, then followed by central beam tracking using conventional monopulse feed tracking.

During guard feed pointing, the desired signal arrives outside the main beam of the surrounding beams and the central beam. The signal output of the guard feed and surrounding feeds have comparable levels when the desired signal arrives sufficiently outside of the surrounding beams and sufficiently inside the guard beam. During guard feed pointing, conventional pointing methods, such as raster, spiral or box scanning, can be used to reposition the antenna main beam so that the desired signal direction lies within the field of view of the feed cluster which can then provide the next level of alignment towards central beam during cluster feed pointing. Once the antenna is positioned with the desired signal arriving within the surrounding beams, cluster feed pointing is then used to further reposition the antenna so that the desired signal arrives within the central beam after which central beam tracking such as monopulse tracking, is used to track the source of the desired signal.

In contrast to the conventional pointing methods using a conventional antenna design, the pointing search can be accomplished more quickly by the present invention. In the conventional design, high sensitivity is achieved by a single main beam. The spatial search is accomplished by repositioning the antenna in angular increments corresponding to the conventional antenna beamwidth. The feed cluster in the present invention together with their respective tracking receivers provide high sensitivity over a much wider angular region than that provided by only the antenna central beamwidth. Consequently, the signal search whether it follows a roster, box, or spiral motion, can be conducted in correspondingly wider angular increments having sensitivity comparable to that of the conventional antenna main beam. Thus, the present invention permits a more rapid search for the signal over an angular region of uncertainty that can be accomplished by the conventional antenna.

The feed cluster within the main beam advantageously provides for an increased field of view using the full gain of the main aperture of the antenna, so that the spatial search can be rapidly conducted with higher sensitivity. This method is well suited for antennas operating at EHF frequencies where high gain, narrow beamwidth designs can be achieved by relatively compact antenna system designs. The method achieves much higher sensitivity by performing the signal acquisition using the main reflector. These and other advantages will become more apparent from the following detailed description of the preferred embodiment.

BRIEF DESCRIPTION OF THE DRAWINGS

FIG. 2 is a graphic representation of beams from the extended spatial acquisition antenna system.

FIG. 3 is a flow chart of a method for extended spatial acquisition.

DETAILED DESCRIPTION OF THE PREFERRED EMBODIMENT

Figure 1:
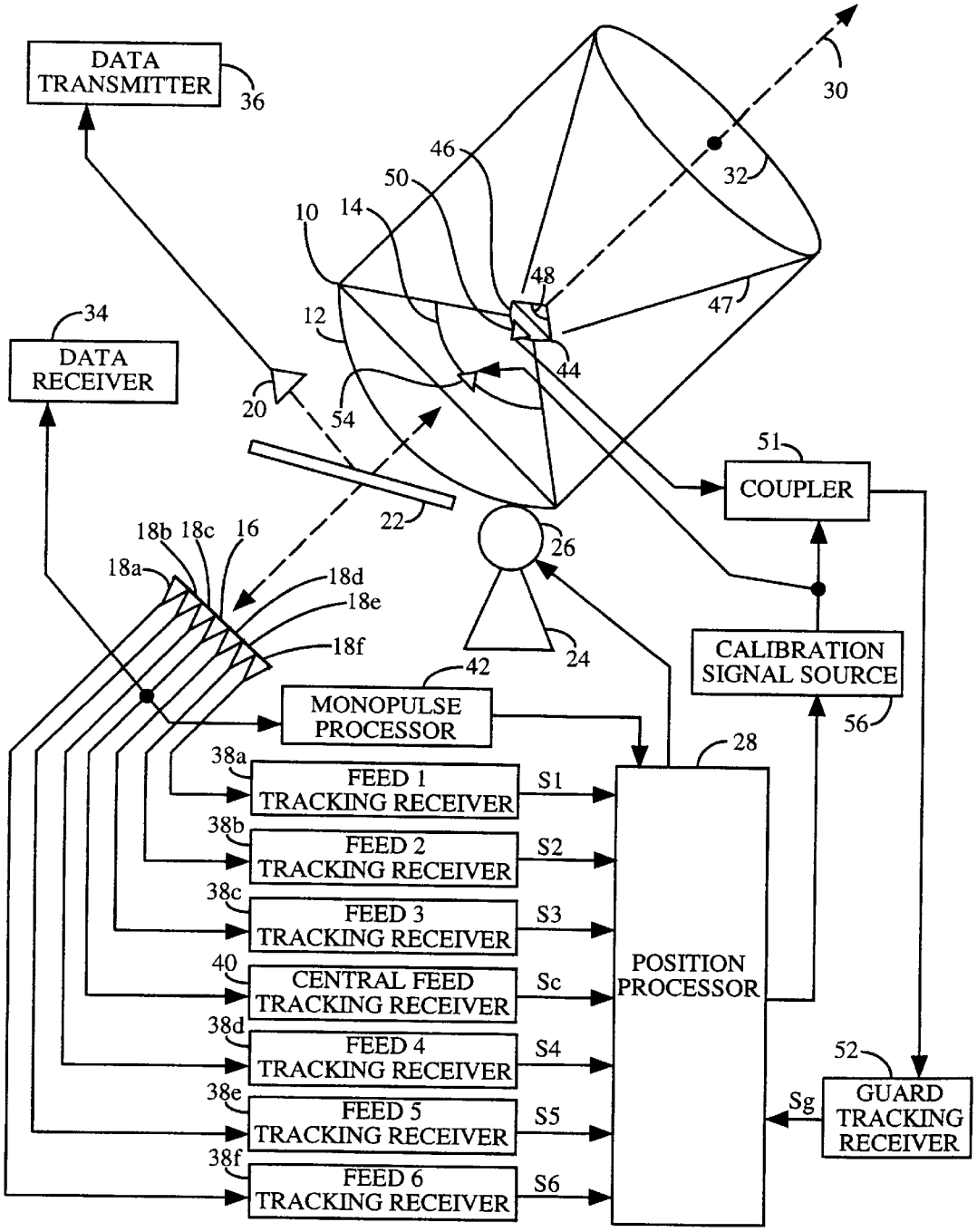
FIG. 1 is a block diagram of an extended spatial acquisition antenna system.

The description of the preferred embodiment is made with reference to the figures using reference designations. Referring to FIG. 1, an extended spatial acquisition antenna system comprises a main antenna 10 which may be described as a conventional Cassegrain antenna. The antenna 10 includes a main reflector 12, a subreflector 14, and a feed system including a central feed 16, a plurality of surrounding feeds 18*a–f*, a transmit feed 20, and a frequency selective surface 22. The main reflector 12 and subreflector 14 may or may not be shaped to increase antenna efficiency. An associated positioning system includes a support 24 for supporting the antenna and includes positioner drive motors 26 controlled by a position processor 28 to move the antenna to arbitrary directions pointing along an antenna axis 30 along which is aligned a main beam 32. The position processor 28 includes the capability to command and verify the movement of the antenna 10. The central feed 16 is preferably a multimode horn providing sum and difference beam patterns.

The central feed 16 of the antenna 10 is connected to a data receiver 34 and the transmit feed 20 is connected to a data transmitter 36 for respectively receiving and transmitting data. The sum pattern output from the central feed 16 is routed to conventional demodulators within the data receiver 34 for signal reception. Each of the surrounding feeds 18*a–f* are respectively connected to surrounding feed tracking receivers 38*a–f* providing surrounding feed signals S1-6 collectively referred to as surrounding feed signals Si. The signals received by the surrounding feeds 18 are referred to as Si, where i equals 1 to n, where n surrounding feeds 18 surround the central feed 16. In the preferred embodiment, n has an exemplar value of six. The central feed 16 is also connected to a central feed tracking receiver 40 providing a central feed signal Sc and a monopulse processor 42 used for monopulse tracking.

The antenna system may further include a guard antenna 44 having a guard reflector 46 providing a guard beam 47, a guard subreflector 48 and a guard feed 50 connected to a coupler 51 and a guard receiver 52 providing a guard signal Sg for sensing sidelobe signals. For calibration purposes, the antenna may also include a probe feed 54 positioned on the main subreflector 14 and connected to a calibration signal source 56 and the coupler 51. The calibration source 56 provides a calibration signal that can be used to calibrate the tracking receivers 38, 40 and 52.

Referring to FIGS. 1 and 2, the multiple feeds 16, 18 and 20 are arranged in the focal region of the antenna 10. The feeds 16 and 18 combine to form the main beam collection 32 comprising a central beam 60 and surrounding beams 62*a–f*. The central feed 16 produces the central beam 60 aligned with the central axis 30 of the antenna 10. The surrounding feeds 18*a–f* produce the surrounding beams 62*a–f* which are equiangularly circumferentially aligned about the central beam 60. The receive feed cluster 16 and 18 contains a number, preferably six, of surrounding cluster feeds 18*a–f* surrounding the central feed 16. Each of the surrounding feeds 18 produce a respective surrounding beam 62*a–f* each having a sum pattern displaced from the antenna axis 28 by an amount proportional to the angular displacement of the respective surrounding beam 62 from the axis 30 extending through the center of the central beam 60. Each of the surrounding feeds 18 produce a respectively surrounding beam pattern 62*a–f* preferably having the same antenna gain levels and pattern as the sum pattern of the central beam 60 but angularly displaced from the axis 30 of the antenna 10. The preferred arrangement of the surrounding feeds 18 is to surround the central feed 16 by a ring having the exemplar six feeds 18. Additional feeds may be used to further expend the acquisition field of view at the expense of further system complexity. Such feed cluster arrangements have been used in multiple beam antenna designs used in satellite antennas. The angular separation between the feeds 16 and 18 in the feed cluster is determined by the minimum sensitivity tolerances. Large angular separations between the feeds 16 and 18 increase the angular coverage of the feed cluster but reduce the minimum antenna gain level in that angular coverage area.

The central feed 16 like the conventional multimode horn designs produces sum and difference patterns for the monopulse operation used in pointing and tracking of the antenna 10 when a desired signal arrives within the beamwidth of the central beam 60 of the central feed 16. The central feed signal Sc received by the central feed 16 comprises a sum pattern signal Scs and a difference pattern signal Scd.

When the antenna 10 is required to both receive and transmit signals, the separate transmit feed 20 is provided because the receive and transmit frequencies differ. The transmit feed 20 is imaged by the frequency selective surface 22 which is reflecting at the transmit frequencies and transparent at the receive frequencies. The frequency selective surface 22 enables processing of the signals for the transmit feed 20 and receive feeds 16 and 18 over their respective operating bandwidths, allows for independent adjustments of the phase centers of the receive feeds 16 and transmit feed 20 to achieve optimum focusing at each operating bandwidth, and provides some if not all of the diplexing needed to isolate the receive and transmit signals by the rejection properties of the frequency selective surface 22 and the separation of the receiving central feed 16 and transmit feed 20. The central feed 16 of the receive feed cluster 16 and 18 and the transmit feed 20 must be aligned to the boresight axis 30 so that the boresight axis 30, defined by the point of maximum antenna gain, of both the transmit beam from the transmit feed 20 and the central beam 60 from the central feed 16 are aligned to be coincident. In this way, pointing losses at both receive and transmit frequencies will be minimized.

The probe 54 is centrally located in the main subreflector 14 and provides a calibration signal from the calibration signal source 56. The calibration signal is radiated by the probe 54 and received by the cluster feeds 16 and 18 for calibrating the tracking receivers 40 and 38, respectively. The calibration signal is also coupled through coupler 51 and received by the guard tracking receiver 52 for calibrating the guard tracking receiver 52. The calibration probe 54 provides a means to compensate for electronic drift in feed circuitry, not shown, and drift in the tracking receivers 38, 40 and 52 that occurs over the operational lifetime of the antenna 10. Two distinct calibration objectives exist. The first calibration objective is to maintain proper operation of the difference pattern in the central feed 16. Any imbalance in feed circuitry shifts the null location of the difference pattern Scd. The ratio of difference pattern over the sum pattern Scd/Scs provides a measure of the difference null alignment without the necessity of absolute calibration. The second calibration objective maintains equal sensitivity of the surrounding feeds 18, and the relative sensitivity of the central feed 16 and the guard feed 50 to the axis 30. The surrounding feeds 18 are configured in a concentric ring surrounding the central feed 16. The symmetry of the surrounding feeds 18 requires equal sensitivity for each surrounding feed 18 in the ring configuration. Any amplitude imbalance measured with the calibration signal by the tracking receivers 38*a–f* indicates electronic drifts which can be measured and compensated.

Similarly, a priori RF calibration can establish the difference in the level of central feed 16 and the surrounding feed cluster 18. This separate RF calibration thus establishes the difference in signal levels between the central feed 16 and the surrounding feed cluster 18 if ideal tracking receivers 38 and 40 were used. In operation, any difference between this a priori RF calibration and the observed response in the actual tracking receivers 38 and 40 is a measure of imperfections and/or drift in the actual receivers 38 and 40.

Finally, the response of the guard antenna 44 and the guard tracking receiver 52 must be related to the response of the central feed 16 and the surrounding feed cluster 18. Again, a priori RF calibration is used, and in this case, the gain difference between the central beam 60 and the guard antenna beam 47 is measured to obtain the response of the guard antenna 44 relative to the surrounding beams 62 and the central beam 60. This a priori RF calibration would be performed during the antenna's construction using commonly available general purpose instrumentation such as network analyzers. This a priori RF calibration provides a system response as if ideal tracking receivers are used. The calibration performed during system operation measures the response of the actual receivers 38, 40, and 52 and the deviations between the ideal response determined in the a priori calibration and the actual calibration response during operation to determine any gain drift and response differences in the actual receivers, which varies during the operational lifetime of the system. These deviations between actual and ideal response of the receivers 38, 40, and 52 are compensated by the position processor 28.

The guard antenna 44 is rigidly positioned behind the subreflector 14 of the main antenna 10 and guard antenna blockage of the main beam 32 is based upon the size of the guard antenna 44 which may be one tenth the diameter of the main antenna 10 resulting in a small loss of about 0.05 dB. The main reflector 12 may forty five feet in diameter. The guard antenna 44 is used for determining whether or not the angular range of the main beam 32 is aligned to the desired signal so that spatial acquisition can be achieved using the cluster feeds 18. The gain of the guard antenna 44 matches the sidelobe gain of the main beam 32 from the feed cluster 16 and 18. Thus, the guard antenna 44 has a much lower gain than the peak levels of the cluster beams 60 and 62 from the feed cluster 16 and 18 and can be located behind the subreflector 14 of the main antenna 10, as shown. By comparing the guard signal level Sg of the guard antenna 44 with the Si and Scs signal levels of the cluster feeds 16 and 18 in the feed cluster, the position processor 28 can determine whether or not the antenna 10 is positioned within the angular range of an arriving desired signal where signal acquisition and subsequent alignment with the central feed 16 can then occur.

A desired signal may arrive within a sidelobe, outside of the main beam 32 of the antenna 10, and be received even though the antenna 10 is not pointing towards the desired signal source. When the desired signal arrives outside the main beam 32, the power level of the guard feed 50 is comparable to the power level of cluster feed 16 and 18. After determining that the desired signal arrives outside of the main beam 32, the antenna 10 can be repositioned so that the desired signal arrives within the main beam 32, after which spatial acquisition can be achieved.

Sidelobe reception is an important feature in applications where a substantial amount of system margin exists, e.g. an EHF system design having a substantial rain margin to permit operation in inclement conditions. When clear, the antenna 10 may achieve acceptable reception when the desired signal is received through an antenna sidelobe, not shown. With adequate signal reception through a sidelobe under clear conditions, the transmit signal may be in a null of the transmit antenna pattern which uses a different frequency than the receive system. Even if the antenna 10 is not used for transmission, the pointing information from one antenna is often used to assist the pointing of a second antenna at a later time period. Thus, the errors resulting from reception on the antenna sidelobe degrade the initial estimate of the pointing for another antenna at a later time. Thus, the use of the guard antenna 44 in determining that the antenna 10 is not receiving through an antenna sidelobe avoids loss of transmission performance and degraded estimate of pointing information used as an initial acquisition estimate by a second antenna at a later time. The guard antenna 44 could also be used as a separate acquisition antenna as is commonly done. However, the reduced sensitivity of a smaller antenna limits the acquisition performance during heavy rain where the rain margin is expended. Moreover, monopulse processing would have to be added to the guard antenna 44 to provide a sufficiently accurate angular estimate of the signal direction so that the main antenna 10 could acquire the desired signal.

The receive electronics, not shown, of the feed cluster 16 and 18 and guard antenna 44 typically respectively include a bandpass filter to limit interference beyond the received signal's bandwidth, a low noise preamplifier to establish the system noise temperature, and a down converter to provide an IF interface with the tracking receivers 38, 40 and 52. The receive electronics are conventionally used in these receive antenna designs. The down converters in each of these duplicative chains of electronics would typically use a local oscillator signal derived from a common frequency reference. The receive electronics are provided at each feed port in the cluster 16 and 18 and in the case of the guard antenna 44 after the calibration coupler 51 preceding the input to the guard tracking receiver 52. The central feed 16 like that of the conventional design has in addition to the receive electronics, the monopulse processor 42 to derive the angular positioning from the sum and difference beams that are unique to the central feed 16.

The feed cluster 16 and 18 preferably contains seven feeds, the central feed 16 and six surrounding feed 18*a–f*. The seven resulting beams 60 and 62*a–f* are shown as respective circles in FIG. 2 to denote the beamwidth associated with each feed 16 and 18. The main beam 32 is segmented by twelve boundary lines 64, only one of which is designated as such for clarity, and segmented by six triple points 64, only one of which is designated as such for clarity. The boundaries 64 denote equal gain level boundaries of the two adjacent beams 60 and 62*a–f*, for example beams 62*f* and 62*e*. The triple points 66 denote equal gain level points of three adjacent beams, for example, beams 62*a*, 62*f* and 60. The outer circle denotes the main beam boundary 32 where the gain of the guard beam 47 of the guard antenna 44 equals the gain of the surrounding beams 62. Within the circular boundary of the main beam 32, the signal level Sg of the guard antenna 44 does not exceed the signal level Scs or Si of any of the seven feeds 16 and 18. Thus, the area within the circular boundary 32 corresponds to the angular region of the main beam 32 where signal acquisition can occur using cluster feed pointing and/or central beam tracking. Beyond the main beam 32, the signal level of the guard antenna signal Sg exceeds the signal levels Scs and Si of any of the seven feeds 16 and 18. Guard antenna reception determination is based on measuring the signals Scs, Si, and Sq in the central feed 16, the surrounding feeds 18, and the guard antenna 44. Thus, the area beyond the circular boundary 32 corresponds to the angular regions of the main beam 32 where cluster feed pointing and/or central beam tracking for signal acquisition does not occur. When the desired signal arrives beyond the circular boundary 32, the antenna 10 must be repositioned during guard feed pointing until the signal arrives within the circular boundary 32.

Referring to all of the Figures, and more particularly to FIG. 3, the spatial acquisition method can be implemented using conventional computer programs and processing steps. After the antenna system is started 70, and prior to attempting to acquire the desired signal, the antenna 10 should be calibrated 72 to assure that electronics gain values are in balance. The position processor 28 can measure imbalances and provide necessary compensation in the tracking receivers 38, 40 and 52. An a priori estimate is firstly calculated 74. The antenna 10 is then positioned 76 using the a priori estimate 74.

After the a priori positioning 76 of the antenna 10, the central feed sum signal Scs, the surrounding feeds signal Si, for i equals one to six, and the guard antenna signal Sg are then measured 78 for guard feed pointing. A determination 80 is made whether or not the angular region of the main beam 32 of the antenna 10 is aligned to the desired signal so that spatial acquisition can then be achieved. The determination 80 is based on determining whether one or more of the Scs or Si signals have a power level that exceeds the power level of the guard antenna feed signal Sg. If the power of guard antenna feed signal Sg exceeds the power level of the cluster feed signal Scs or Si, the antenna 10 is determined to be positioned so that the desired signal arrives beyond the angular region of the main beam 32. As such, additional searching must be performed to position the main beam 32 within the angular region of the desired signal where spatial acquisition can then be achieved. The antenna 10 is commanded to be repositioned 82 by moving in a raster, box, or spiral search similar to the search used in conventional pointing methods. However, instead of searching in increments corresponding to the beamwidth of the central beam 60 of the antenna 10, the search is conducted in increments corresponding to the increased spatial acquisition size of the entire main beam 32, so that the guard feed pointing search can be more rapidly accomplished.

After repositioning 82 the antenna 10, the feed signals Scs, Si and Sg are measured 78 again, and the determination

80 is made again. The initial pointing loop of steps 78, 80 and 82 are repeated until the antenna 10 is aligned with the desired signal arriving within the main beam 32. Guard feed pointing is completed when the power level of the guard signal Sg is less than the feed signals Si and Scs, when it is determined 80 that the desired signal is arriving within the main beam 32.

Once the antenna 10 is aligned having the angular region of the main beam 32 aligned to the desired signal, where spatial acquisition can occur, the next task is to more precisely align the antenna 10 so that the desired signal arrives within the beamwidth of the central beam 60. This alignment is accomplished by cluster feed pointing. Cluster feed pointing can be accomplished in several different ways. Cluster feed pointing may be accomplished by commanding the antenna 10 to move in angular increments based on the signal level measurements 78.

After determining 80 that the guard signal Sg is not greater than any of the cluster feed signals Si and Scs, the cluster feed pointing is invoked and first determines 84 if the central feed signal Scs is less than the surrounding feed signals Si which indicates that the desired signal arrives within one of the surrounding beams 62. In this case, the signal arrives within a surrounding beam 62, and the signal level Si of one of the outer beams 62*a–f* exceeds the level of the remaining others. The desired signal arrives within a surrounding beam, e.g. beam 62*a*, when the corresponding signal Si is greater than the Si signals of the remaining other surrounding beams, e.g. 62*b–f*. Special cases can also occur. When the desired signal arrives on a boundary 64 between adjacent beams 62, for example, the boundary line 64 between beams 62*e* and 62*f*, the signal power of the two beams 62*e* and 62*f* will have the same power levels. When the desired signal arrives on a triple point 66 between three adjacent beams, for example, the triple point 66 between beams 62*a*, 62*f* and 60, the signal power of the two surrounding beams 62*a* and 62*f* will have the same power level as the power level of the signal Scs from the central beam 60. The power levels of the feed signals Scs and Si therefore indicate the angular location of the arrival of the desired signal within the main beam 32. When the central feed signal Scs is determined 84 to be less than the surrounding feed signals Si, the antenna 10 is repositioned 86 towards the central beam 60 during cluster feed pointing.

Cluster feed pointing effectively determines which one of the surrounding beams 62 has the highest signal level, and commands 86 the antenna 10 to move so that the desired signal arrival moves radially from the surrounding beam 62 toward the central beam 62 by an amount preferably corresponding to the beamwidth of one of the beams 62. The signal powers of the signal Si and Scs are then remeasured again 88. With such a radial movement, two distinct possibilities exist. The first is that the Scs signal of the central beam 60 now exceeds the level of any other signal Si of the surrounding beam 62. When the Scs signal exceeds the level of the surrounding feed signals Si, then the central beam 60 is continuously aligned towards the desired signal during central feed monopulse tracking 90. The second is that the signal level of one of the surrounding feed signal Si will still have the highest signal level. When a surrounding feed signal Si has the highest signal level, then the antenna 10 will be again commanded 86 to move the antenna 10 by a beamwidth along the radial path towards the central beam 60 and the signal levels are measured 88 again which should indicate a maximum signal level of the central feed signal Scs of the central beam suitable for central feed monopulse tracking 90.

Cluster feed pointing may further be refined by radial half steps. Refined cluster feed pointing 92 determines whether or not the antenna 10 is positioned such that the desired signal arrives within the beamwidth of the central beam 60 or is grossly positioned such that the desired signal arrives along the boundaries 64 of the central beam 60. Two distinct techniques can be used for this determination. The first technique compares the ratio of the power in the central beam 60 with the highest power level in the surrounding beams 62. If the central beam power exceeds the maximum power of any of the surrounding beams by a sufficiently large predetermined amount, the antenna 10 is aligned so that the desired signal arrives within the beamwidth of the central beam. The predetermined amount of the power difference depends on the beam patterns and the crossover level between the beams 60 and 62, which can be determined a priori for a specific implementation. If this predetermined amount is not exceeded, the antenna 10 can be commanded 92 to move by one-half of a beamwidth radially toward the central beam 60 which would place the desired signal within the beamwidth of the central beam 60.

The second technique for fine cluster feed pointing for aligning the antenna 10 to within the beamwidth of the central beam 60 uses the monopulse outputs from the monopulse processor 42. If the desired signal arrives beyond the beamwidth of the central beam 60, the signal level in the difference pattern Scd will exceed that of the sum pattern Scs. Knowing the highest power of the surrounding feeds signals Si, the antenna 10 can be commanded 92 to move radially towards the center of the central beam 60 by a predetermined fixed amount, e.g., one-half beamwidth. Monitoring the sum and difference outputs Scs and Scd during antenna movement provides a means to determining whether or not the difference pattern of the central feed 16 is operating within the linear region so that central feed monopulse tracking 90 can then occur.

Once the antenna 10 is positioned so that the desired signal arrives within the beamwidth of the central beam 60, the monopulse tracking 90 is used in the conventional way to establish the final pointing and tracking of the antenna. Monopulse circuitry is used after central beam alignment to maintain signal alignment 94 while the antenna 10 is receiving and/or transmitting data. The need to maintain signal alignment during the reception and transmission arises because the direction of the signal may vary during the period of reception and transmission, e.g. during communications with a low altitude satellite. The data receiver 34 spectrally acquires the desired signal through carrier tracking and code alignment depending on signal modulation as is well known.

The extended spatial acquisition method spatially acquires a desired signal over a substantially wider angular region of a main beam 32 consisting of a collection of beams including the central beam and surrounding beams than the antenna central beam beamwidth for performing the spatial acquisition with the sensitivity of the main antenna reflector 12. The method includes cluster feed pointing based upon the power levels of surrounding feed signals Si as compared to the central feed signals Scs and Scd. The preferred guard feed pointing steps 78, 80 and 82 further enhances the method for spatial acquisition of a desired signal, by precluding the undesired result of antenna reception in the sidelobes of the main beam 32.

The surrounding feeds 18 within the feed cluster could also use multimode horns for providing respective sum and difference patterns. When the cluster beams 62 receive predominate signal power from the desired signal indicating that the desired signal arrives within the cluster beams 62, the monopulse tracking methods provides an estimate of the desired signal location within the cluster for repositioning the composite beam 32 towards the desired signal. However, the use of the monopulse tracking method using the cluster beams 62 increases system complexity.

A tradeoff exists in locating additional cluster feeds 18. Wide separation from the central feed 16 increases the field of view, but also results in a lower minimum gain value within the field of view of the main beam 32. For example, at a minimum gain level of ten dB lower than the peak gain level of about ten dB, the field of view for spatial acquisition expands to about five times for a seven feed cluster and about nine times for a nineteen feed cluster.

The extended spatial acquisition method comprises cluster feed pointing based upon an analysis of surrounding feed and central feed signals. The main beams 32 and corresponding feeds 16 and 18 provide for a mapping of received signal power strengths over the field of view, so that arrival direction determinations can be made to indicate wherein within the expanded field of view the desired signal arrives, so that, the antenna 10 can be repositioned to move the central beam 60 towards the source of the desired signal. The particular cluster arrangement can be modified and various arrival direction determinations can be used. The method may be improved and enhanced, but those improvements and enhancements may nonetheless fall within the spirit and scope of the following claims.

What is claimed is:

1. A cluster feed pointing method for repositioning an antenna towards a desired signal, the method comprising the steps of, providing a main beam comprising a central beam and a plurality of surrounding beams of the antenna, measuring respective surrounding feed signals from the surrounding beams, measuring a central feed signal from the central beam, determining where the desired signal arrives within the surrounding beams, and repositioning the central beam towards the desired signal when the desired signal arrives within the surrounding beams.

2. The method of claim 1 wherein the determining step, the desired signal arrives within one of the surrounding beams when the one respective surrounding feed signals is greater than central feed signal.

3. The cluster feed pointing method of claim 1 further for central beam tracking, the method further comprising the steps of, determining when the desired signal arrives within the central beam, and continuously aligning the central beam to the desired signal when the desired signal arrives within the central beam.

4. The method of claim 3, wherein, the central beam signal comprises sum and difference patterns, and the central beam tracking step is a monopulse tracking step.

5. The cluster feed pointing method of claim 1 further for guard feed pointing, the method further comprising the steps of, aligning a guard beam to be coincident with and larger than the main beam, measuring guard feed signals from the guard beam, determining when the desired signal arrives outside of the main beam, and repositioning the main beam towards the desired signal when the desired signal arrives outside of the main beam.

6. The method of claim 1, wherein the providing step, the surrounding beams are equiangularly disposed around the central beam.

7. An extended spatial acquisition method for acquiring a desired signal by an antenna, the method comprising the steps of, providing a main beam comprising a central beam and a plurality of surrounding beams of the antenna, aligning a guard beam to be coincident with and larger than the main beam, measuring guard feed signals from the guard beam, measuring respective surrounding feed signals from the surrounding beams, measuring a central feed signal from the central beam, determining when the desired signal arrives outside of the main beam, repositioning the main beam towards the desired signal when the desired signal arrives outside of the composite beam, determining where the desired signal arrives within the surrounding beams, repositioning the central beam towards the desired signal when the desired signal arrives within the surrounding beams, determining when the desired signal arrives within the central beam, and continuously aligning the central beam to the desired signal when the desired signal arrives within the central beam.

8. The method of claim 7, wherein there are six surrounding beams equiangularly surrounding the central beam.

9. The method of claim 7 wherein the guard beam has a beamwidth ten times greater than the main beam.

10. The method of claim 7 wherein the central beam and surrounding beams all have equal beamwidths.

11. The method of claim 7 wherein the repositioning of the central beam step, the antenna is repositioned by an angular amount equal to a beamwidth of the surrounding beams.

12. The method of claim 11 further comprising the steps of, determining when the maximum of any of the surrounding feed signals equals the central feed signal, and finely repositioning of the central beam towards the desired signal by an amount less than a beamwidth of the central beam.

13. The method of claim 12 wherein the finely repositioning steps reposition the central beam towards the desired signal by an angular amount equal to one half of a beamwidth of the central beam.

14. The method of claim 7 wherein the determining step for determining when the desired signal arrives within the surrounding beams enables the repositioning of the central beam toward the desired signal to occur without using the central beam to independently search for the desired signal for increased speed of desired signal acquisition.

* * * * *